US009443679B2

(12) United States Patent
Cassarino

(10) Patent No.: US 9,443,679 B2
(45) Date of Patent: Sep. 13, 2016

(54) TWO-PIECE ROCKER ASSEMBLY

(71) Applicant: Vincent Cassarino, Meriden, CT (US)

(72) Inventor: Vincent Cassarino, Meriden, CT (US)

(73) Assignee: Carling Technologies, Inc., Plainville, CT (US)

( * ) Notice: Subject to any disclaimer, the term of this patent is extended or adjusted under 35 U.S.C. 154(b) by 263 days.

(21) Appl. No.: 14/075,379

(22) Filed: Nov. 8, 2013

(65) Prior Publication Data

US 2015/0129404 A1 May 14, 2015

(51) Int. Cl.

| | |
|---|---|
| ***H01H 3/00*** | (2006.01) |
| ***H01H 13/00*** | (2006.01) |
| ***H01H 23/14*** | (2006.01) |
| ***H01H 3/20*** | (2006.01) |

(52) U.S. Cl.

CPC ..... *H01H 23/143* (2013.01); *H01H 3/20* (2013.01); *H01H 2300/024* (2013.01); *Y10T 29/49105* (2015.01)

(58) Field of Classification Search

CPC ..... H01H 23/00; H01H 23/02; H01H 23/04; H01H 23/14; H01H 23/16; H01H 23/24; H01H 27/00; H01H 2003/00; H01H 2003/02; H01H 2021/00; H01H 2221/00; H01H 2221/016; H01H 2223/00; H01H 2223/01; H01H 2223/012; H01H 2223/034; H01H 3/00; H01H 13/00

USPC ..... 200/329, 336, 339, 529, 538, 557–559, 200/553, 401, 409, 457, 459

See application file for complete search history.

(56) References Cited

U.S. PATENT DOCUMENTS

| | | | | |
|---|---|---|---|---|
| 3,267,248 | A * | 8/1966 | Bagley | H01H 23/14 200/330 |
| 4,002,874 | A * | 1/1977 | Brown | H01H 9/26 200/321 |
| 4,169,972 | A * | 10/1979 | Black, III | H01H 23/164 200/315 |
| 4,291,207 | A * | 9/1981 | Reinke | H01H 27/00 200/325 |
| 5,250,771 | A * | 10/1993 | Brusasco | B60R 16/005 200/292 |
| 6,545,239 | B2 | 4/2003 | Spedale et al. | |

FOREIGN PATENT DOCUMENTS

| | | |
|---|---|---|
| EP | 0653770 A1 | 5/1995 |
| EP | 1081730 B1 | 3/2001 |

* cited by examiner

*Primary Examiner* — Renee Luebke
*Assistant Examiner* — Anthony R. Jimenez
(74) *Attorney, Agent, or Firm* — St. Onge Steward Johnston & Reens, LLC

(57) ABSTRACT

A two-piece rocker assembly having an inner rocker and an outer rocker, the inner rocker being snap-fit into the outer rocker via a connection between at least one flange and at least one latch beam. In certain embodiments, a locking member is added to the two-piece rocker assembly.

18 Claims, 9 Drawing Sheets

TWO-PIECE ROCKER ASSEMBLY

FIELD OF THE INVENTION

The invention generally relates to electrical switches and more specifically relates to a two-piece rocker assembly for use in a rocker switch.

BACKGROUND OF THE INVENTION

Rocker switches are used as electrical switches in industry, domestically and in automobiles, boats and airplanes, for example. Because of their wide application and large scale manufacture, the unit price of rocker switches is relatively low. There are applications in which it is useful to take advantage of the low unit cost of rocker switches, and where it is desirable to enhance them.

Various rocker switch assemblies are known in the prior art. Rocker switch assemblies are made from a standard switch base, and a rocker assembly is typically mounted onto the switch base via a bracket, which is in turn mounted on the switch base. The rocker switch assemblies include protrusions that allow the rocker switch assembly to rock and pivot with respect to the bracket.

In the prior art, rocker switch assemblies have suffered from various deficiencies. Such deficiencies include the rocker switch not being aesthetically pleasing. Other deficiencies include various problems associated with rocker switches, such as the rocker switches not being easy to produce, and having various problems regarding the fit of the rocker assembly on the bracket and switch base, the fit being a result of poor manufacturing and production techniques. Other problems of prior art designs that include locks on rocker switches involve the lock on the rocker assembly falling out or becoming stuck, whereby the lock is prone to failure as it becomes stuck in use and fails over time due to poor manufacturing.

Prior art rocker switch assemblies have typically been made using a 2-step molding process, which requires expensive tooling and requires a step of overmolding, or molding two pieces onto one another to create the rocker switch assembly.

The 2-step molding process of the prior art has significant disadvantages as a 2-step molding process often results in shrinkage problems from overmolding, which results in production issues whereby components of the rocker switch assemblies do not fit correctly together.

As can be seen, a need exists to provide a rocker switch and rocker assembly that overcomes the disadvantages of the prior art.

SUMMARY OF THE INVENTION

Accordingly, it is an object of the invention to provide for a two-piece rocker switch assembly (rocker assembly) that overcomes the disadvantages of the prior art. It is another object of the invention to provide a two-piece rocker assembly that is easy and inexpensive to produce.

These and other objects of the invention are achieved by providing a rocker switch comprising: a switch base; a bracket mounted on the switch base; and a rocker assembly mounted on the bracket, the rocker assembly able to pivot on the bracket, the rocker assembly including: an outer rocker having an interior body, the interior body of the outer rocker having at least one retention member; and an inner rocker having at least one latch beam that engages the at least one retention member to allow the inner rocker to be secured within the inner body of the outer rocker, the inner rocker being snap-fit within the outer rocker.

In certain embodiments, the outer rocker has four retention members and the inner rocker has four latch beams, wherein each of the four retention members are correspondingly engaged with one of the four latch beams to secure the inner rocker within the inner body of the outer rocker.

In certain embodiments, the inner rocker is secured to the outer rocker by snap-fitting the inner rocker within the inner body of the outer rocker, such that the snap-fitting occurs during assembly of the rocker switch.

In certain embodiments, the inner rocker has a body having a substantially rectangular shape and at least one opening within the body.

In certain embodiments, each of the four latch beams are located at each corner of the rectangular shape of the inner rocker and the four latch beams are each angled in a plane away from the body of the inner rocker. In certain embodiments, the four latch beams are angled approximately 45 degrees from the body of the inner rocker. In other embodiments, the four latch beams can be angled less than or greater than 45 degrees from the body of the inner rocker.

In certain embodiments, the inner rocker has a stem, the stem engaged with the switch base.

In certain embodiments, the at least one latch beam is snapped in underneath the retention member, such that the at least one beam is held in place by the retention member securing the inner rocker within the inner body of the outer rocker.

In certain embodiments, the outer rocker has at least one guide, the at least one guide able to locate and retain the inner rocker within the inner body of the outer rocker.

In certain embodiments, the inner rocker has at least one horizontal flange, the at least one horizontal flange able to engage with the at least one guide to retain the inner rocker within the outer rocker.

In certain embodiments, the outer rocker has four guides and the inner rocker has four horizontal flanges, the four guides engaged with the four horizontal flanges to retain the inner rocker within the outer rocker.

In certain embodiments, the inner rocker has four external flanges, the four external flanges engaged with the four guides to secure the inner rocker within the outer rocker.

In certain embodiments, the outer rocker has a window.

In certain embodiments, the rocker assembly includes a locking member, the locking member having a body located within a pocket between the inner rocker and the outer rocker.

In certain embodiments, the locking member is slidable within the pocket between the inner rocker and the outer rocker, wherein the locking member includes a sliding surface for sliding the locking member along a surface of the inner rocker.

In certain embodiments, the locking member includes a spring, the spring providing a force against the locking member sliding along the surface of the inner rocker.

In certain embodiments, the inner rocker includes a post, the post supporting a first end of the spring to prevent the locking member from sliding along the surface of the inner rocker and keeping the locking member in a closed position.

In certain embodiments, the locking member has a center hole for housing a second end of the spring, the spring being contained in a compressed state between the center hole of the locking member and the post located on the inner rocker.

In certain embodiments, the locking member includes locking features on the locking member, the locking features able to engage with corresponding locking features on the switch bracket.

In certain embodiments, the locking member has flanges on either side of the locking member, the flanges being captured in the pocket formed between the outer rocker and the inner rocker, the flanges being retained on the sliding surface for sliding the locking member along the surface of the inner rocker.

Other objects of the invention are achieved by providing a method for manufacturing a rocker switch, the method comprising the steps of: providing a switch base; mounting a bracket on the switch base; providing a rocker assembly including an outer rocker having at least one retention member and an inner rocker having at least one latch beam; snap-fitting the inner rocker within the outer rocker, so that the at least one latch beam is snap-fit within the at least one retention member to secure the inner rocker within the outer rocker; and mounting the rocker assembly on the bracket.

In certain embodiments, the method further comprises providing a locking member and placing the locking member between the outer rocker and inner rocker prior to snap-fitting the inner rocker within the outer rocker, so that the locking member is held in a pocket between the outer rocker and inner rocker.

In certain embodiments, the inner rocker and the outer rocker are manufactured separately. In certain embodiments, the inner rocker and the outer rocker are not manufactured via a 2-step molding process, but instead are manufactured separately and are snap-fit together during assembly.

Other objects of the invention are achieved by providing a rocker switch comprising: a switch base; a bracket mounted on the switch base; and a rocker assembly mounted on the bracket, the rocker assembly able to pivot on the bracket, the rocker assembly including: an outer rocker having four retention members; an inner rocker having four latch beams that each engage one of the four retention members to allow the inner rocker to be secured by the outer rocker; and a locking member, the locking member located with a pocket between the inner rocker and the window of the outer rocker, the locking member including a sliding surface for sliding the locking member along a surface of the inner rocker and a spring providing a force against the locking member sliding along the surface of the inner rocker, such that the locking member is able to move from a locked (engaged) position to an unlocked (disengaged) position by sliding the locking member longitudinally along the sliding surface of the inner rocker, wherein the inner rocker is secured to the outer rocker in a snap-fit manner.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

The present invention is directed to a new two-piece snap-fit rocker assembly for use in a rocker switch where the inner rocker snaps into the outer rocker. This overcomes issues in the prior art, which involves rockers assemblies manufactured by a 2-step over molding process whereby the inner rocker and outer rocker are molded together. The 2-step over molding process often results in shrinkage problems, which results in production issues whereby components of the rocker switch assemblies do not fit correctly together and/or have aesthetical problems. The 2-step over molding process also requires much more expensive tooling.

Figure 1:
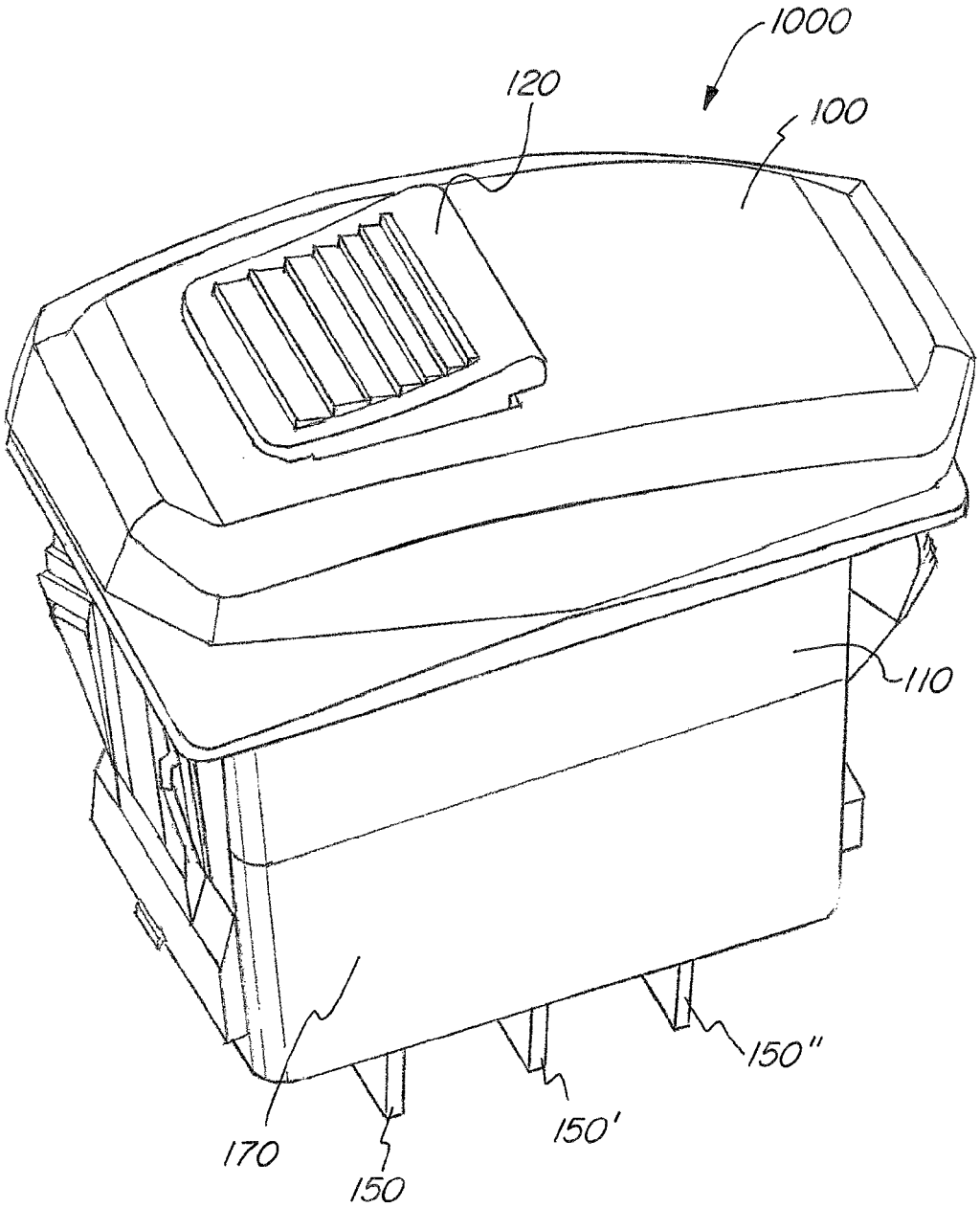
FIG. 1 is a perspective view of a rocker switch of an embodiment of the present invention.

Turning now in detail to the drawings, FIG. 1 is a perspective view of a rocker switch 1000 of an embodiment of the present invention. Here, the rocker switch 1000 is shown having a rocker assembly 100 with a locking member 120, the rocker assembly being mounted on bracket 110. Bracket 110 is in turn mounted on a switch base 170. The switch base 170 is a standard switch base and bracket 110 is a standard switch bracket. However, the rocker assembly 100 is a new 2-piece snap fit rocker assembly where the inner rocker snaps into the outer rocker (also referred to as a sub-rocker and rocker respectively) and includes a sliding lock 120 that is captured between the outer rocker and inner rocker.

Figure 2:
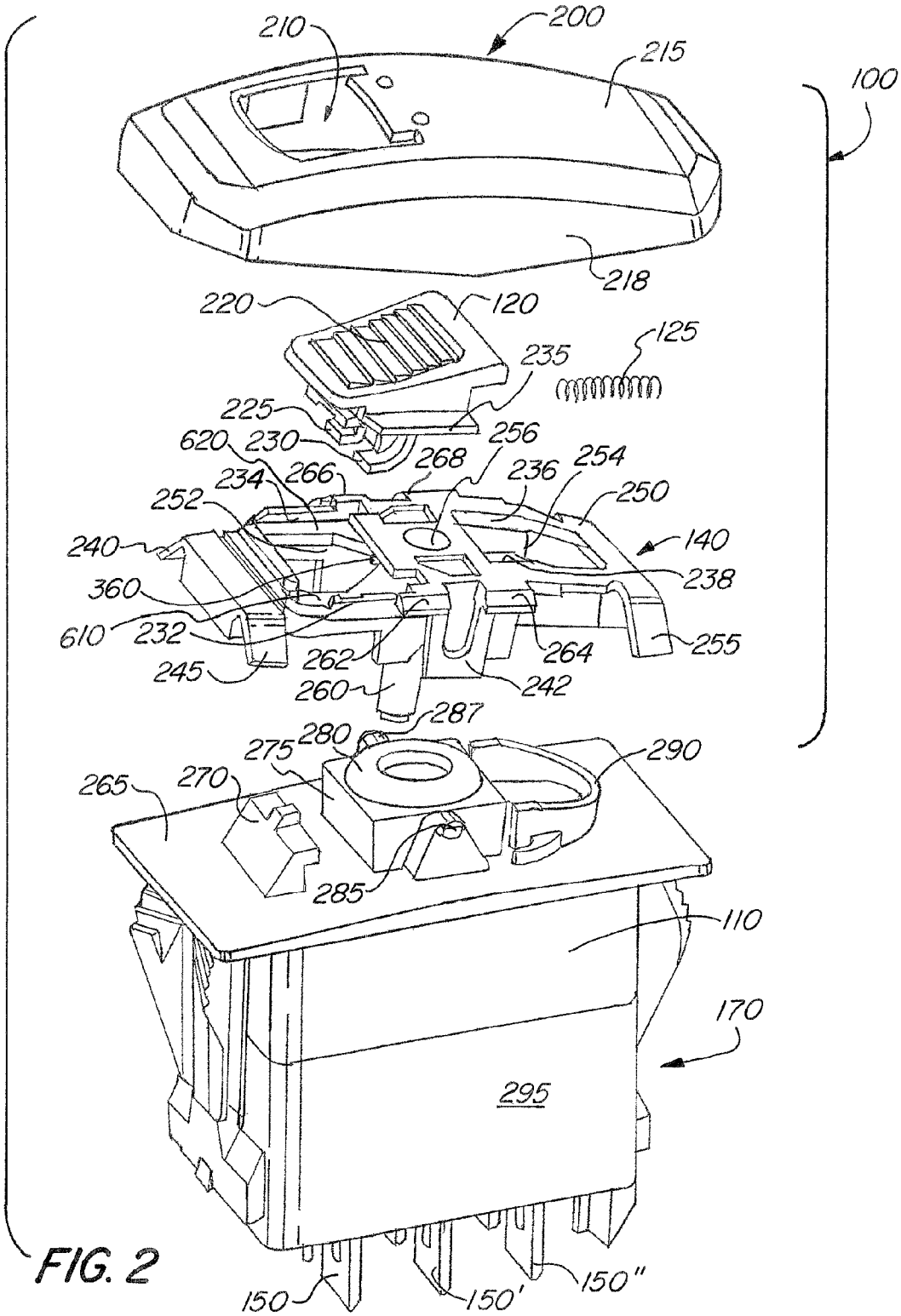
FIG. 2 is an exploded view of the rocker switch of FIG. 1.

Referring to FIG. 2, an exploded view of rocker switch 1000 of FIG. 1 is shown. Rocker switch 1000 includes outer rocker 200 having a top surface 215 and a body 218. The outer rocker 200 is shown having a window 210. The body 218 of the outer rocker 200 is shown being curved such that the body 218 has an arc shape. In certain embodiments, the outer rocker 200 is made of a hard plastic material or an insulating material. In certain embodiments, the outer rocker is a shell or a cap. In certain embodiments, the outer rocker is manufactured as a single piece by using a mold and molding process.

In FIG. 2, the locking member 120 is shown having ribs 220 that are ergonomic to suit an operator's finger. The locking member has flanges 235 and 237 (shown in FIGS. 2, 5 and 6) that retain the locking member in a cavity between the outer rocker 200 and the inner rocker 140. The locking member also has locking features 225 and 230 that mate with corresponding locking features on the switch bracket 110.

Also shown in FIG. 2 is spring 125. In certain embodiments, spring 125 is a standard compression spring. The spring is used to hold the locking member in place in a locked (engaged) position and when compressed exerts a force to hold the locking member in the locked (engaged) position.

Inner rocker 140 is also shown in FIG. 2. Inner rocker 140 has four latch beams 240, 245, 250 and 255. Latch beams 240, 245, 250 and 255 are shown as each being in a corner of the inner rocker 140. Latch beams 240, 245, 250 and 255 are shown as being angled at 2 planes away from the body 140 of the inner rocker. In certain embodiments, the latch beams are flexible. In certain embodiments, the inner rocker is made of a hard plastic material or an insulating material. In certain embodiments, the inner rocker is a shell or a cap. In certain embodiments, the inner rocker is manufactured as a single piece by using a mold and molding process.

Inner rocker 140 also has various features 242 and 244 that snap onto the bracket pivot points 285 and 287 on the switch bracket 110. In certain embodiments, the various features 242 and 244 extend away and substantially perpendicularly from the body of the inner rocker 140. Inner rocker 140 is shown having windows 252 and 254, as well as bore 256. The purpose of window 254 is to allow the light path for rocker images. Bore 256 is used to maintain a more uniform wall thickness. The locking member fits within window 252 when engaged with inner rocker 140. Window 252 and 254 allow the inner rocker to have a cavity, so that the inner rocker 140 is able to pivot along the bracket 110. Inner rocker 140 is shown having a stem 260. The stem 260 engages with the switch actuator. Inner rocker 140 also has pockets to guide and retain the lock flanges.

Furthermore, inner rocker 140 also has sliding surface 610 and 620, whereby the locking member 120 is able to slide on the sliding surface 610 and 620 to actuate the lock.

FIG. 2 also shows inner rocker 140 having external flanges 262, 264, 266 and 268 as well as horizontal flanges 232, 234, 236 and 238. The external flanges and horizontal flanges allow the inner rocker 140 to be secured within the body of the outer rocker 200, as the external flanges 262, 264, 266 and 268 and horizontal flanges 232, 234, 236 and 238 fit with the outer rocker 200 to position the inner rocker 140 within the outer rocker 200.

In certain embodiments, inner rocker 140 transmits light for image illumination and can accept paint. In certain embodiments, the inner rocker incorporates features to guide and retain the lock and prevent its extraction.

FIG. 2 also has a switch bracket 110 having an upper surface 265. Located on the upper surface is locking feature 270 that corresponds to flanges 225 and 230 of the locking member 120. Additional configurations of locking feature 270 are shown in FIGS. 9A-9H. In certain embodiments, locking feature 270 may be replaced by one or more locking features of various configurations.

Switch bracket 110 also has a bore 280 that receives the stem 260. The bore is supported by a support mount 275 and horizontal protrusions 285 and 287 as well as a tapered section 290. The horizontal protrusions 285 and 287 engage with features 242 and 244 to snap onto the inner rocker 140 onto the switch bracket 110. The inner rocker 140 is mounted on the support mount 275 and is able to pivot with respect to the support mount 275 and the tapered section 290. In certain embodiments, the tapered section 290 is hollow, so that a cavity is formed that allows the inner rocker 140 to pivot along the bracket 110. Upon pivoting of the inner rocker, the stem 260 is able to actuate the switch to turn the switch on and off.

Also shown in FIG. 2 is switch base 170 having a body 295 and electrical connections 150, 150' and 150". As shown there are three electrical connections, though additional or fewer electrical connections may be used in the invention.

Figure 3:
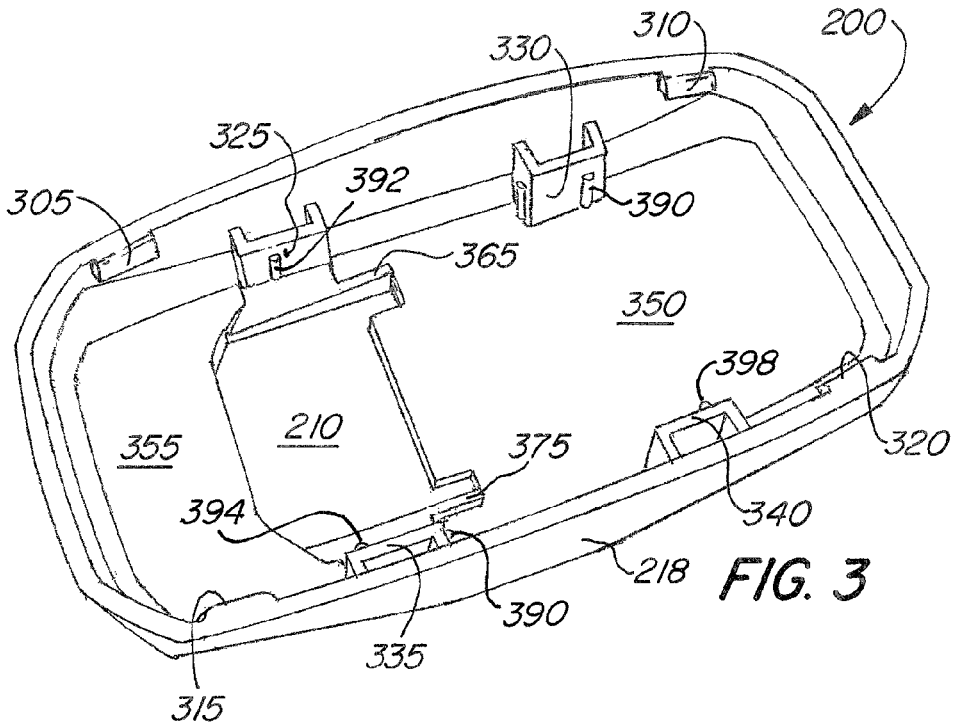
FIG. 3 is a bottom view of the outer rocker of FIG. 1.

FIG. 3 is a bottom view of outer rocker 200 of FIG. 1. FIG. 3 shows the window 210 of the outer rocker as well as inner surfaces 350 and 355 of the outer rocker 200.

Also shown are retention members 305, 310, 315 and 320. The retention members 305, 310, 315 and 320 extend from the outer body 218 of the outer rocker 200, such that the retention members 305, 310, 315 and 320 extend inwardly towards the center of the outer rocker 200. In certain embodiments, the retention members 305, 310, 315 and 320 are located in the corners of the outer rocker 200. In certain embodiments, the outer rocker 200 has a rectangular or substantially rectangular shape. In certain embodiments, the outer rocker 200 has an arc shape. In certain embodiments, the outer rocker 200 has a rectangular shape with curved edges connecting each of the sides of the outer rocker. In certain embodiments, the retention members 305, 310, 315 and 320 are part of the one-piece design of the outer rocker 200. In certain embodiments, the retention members 305, 310, 315 and 320 each have a straight edge so as to mate with the latch members of the inner rocker 140.

Outer rocker 200 also has guides 325, 330, 335 and 340. The guides have an H-shape or have an open rectangular shape, where one end of the rectangle is open. The guides 325, 330, 335 and 340 are used to retain the inner rocker 140 within the outer rocker 200. In certain embodiments, the guides 325, 330, 335 and 340 provide pressure on the external flanges and horizontal flanges of the inner rocker 140 to hold and secure the inner rocker 140 within the outer rocker 200. In certain embodiments, crush ribs 390 and 392 are provided on the guide surfaces to ensure a tight fit with inner rocker 140. Crush ribs 390 and 392 may be located on each side of the guides 325, 330, 335 and 340.

Figure 4:
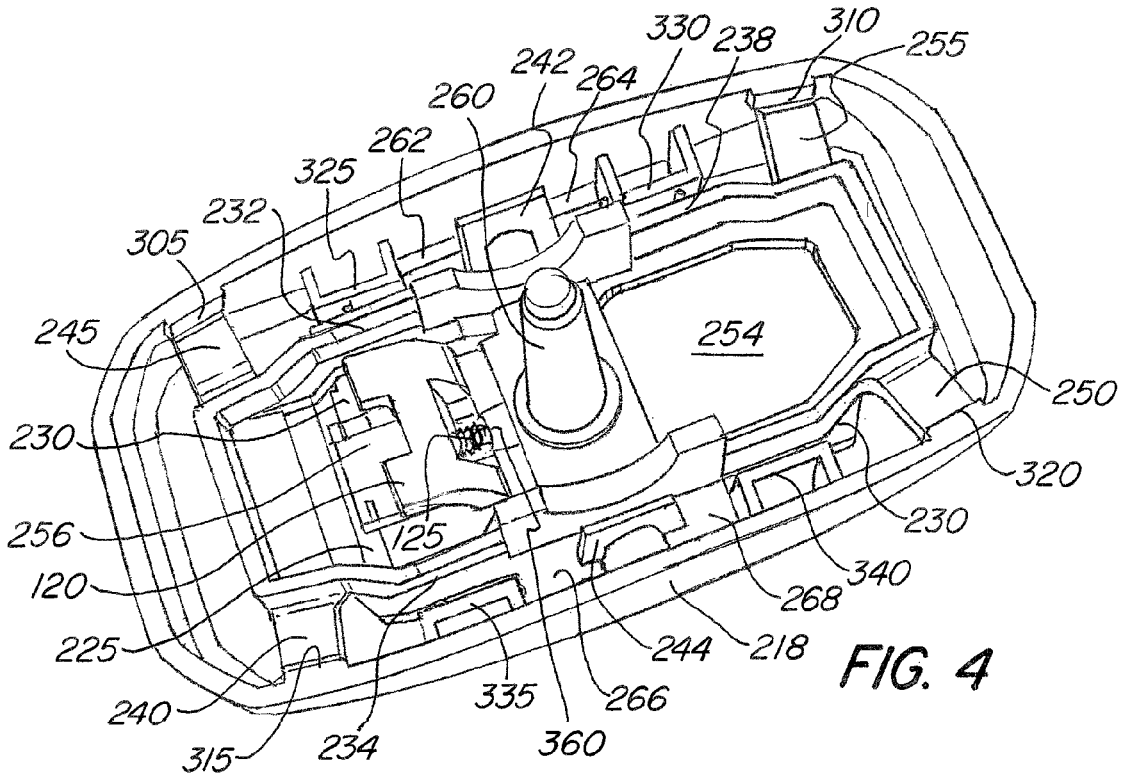
FIG. 4 is a bottom view of the rocker assembly of FIG. 1 with the inner rocker snap-fit within the outer rocker.

FIG. 4 shows a bottom view of the inner rocker 140 after being snap-fit within the outer rocker 200. As shown, the latch beams 240, 245, 250, 255 correspond to retention members 315, 305, 320 and 310 respectively. The engagement of the four retention members 315, 305, 320 and 310 with the four latch beams 240, 245, 250, 255 secures inner rocker 140 within the inner body of the outer rocker 200. The latch beams 240, 245, 250, 255 are snapped in below the retention members 315, 305, 320 and 310 and the force exerted by the retention members 315, 305, 320 and 310 on the latch beams 240, 245, 250, 255 secures the inner rocker 140 in place.

Also shown are guides 325, 330, 335 and 340 assisting in retaining and securing the inner rocker 140 to the outer rocker 200. The external flanges 262, 264, 266 and 268 as well as horizontal flanges 232, 234, 236 and 238 allow the inner rocker 140 to be secured within the body of the outer rocker 200, specifically through the engagement with the flanges 325, 330, 335 and 340 of the outer rocker 200.

Also shown in FIG. 4 is locking member 120 being placed into the cavity (pocket) between the inner rocker 140 and outer rocker 200, so that the flanges 235, 237 of the locking member 120 are inside the cavity between the inner rocker 140 and outer rocker 200.

During the production method, the locking member 120 is placed into the cavity of the inner rocker 140 and outer rocker 200 so that the flanges 235, 237 are inside the cavity. The inner rocker 140 is then snap fit into the outer rocker 200. The locking member 120 is captured in the cavity between the inner rocker 140 and outer rocker 200. In use, the locking member 120 is able to slide longitudinally within the cavity.

In FIG. 4, the locking member 120 is held in place by a spring 125 whereby one end of the spring 125 is attached to post 360 on the inner rocker 140. The spring 125 holds the locking member in a locked (engaged) position. If the spring 125 is actuated by moving the locking member 120, the locking member 120 is moved to an unlocked (disengaged) position, whereby the rocker assembly 100 is able to pivot along the switch bracket 110.

Also shown in FIG. 4 are various features 242 and 244 that snap the inner rocker 140 onto the bracket pivot point, allowing the inner rocker 140 and rocker assembly 100 to be retained by the switch bracket 110.

Figure 5:
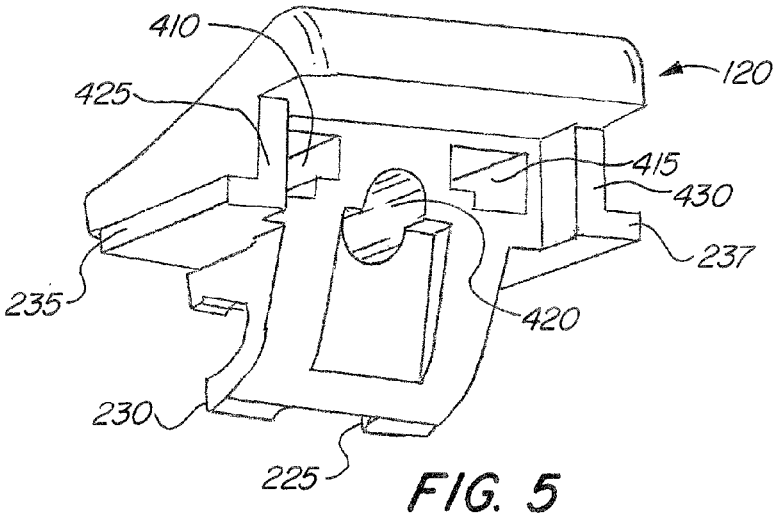
FIG. 5 is a perspective view of the locking member of FIG. 1.

FIG. 5 shows a perspective view of the locking member 120. Locking member 120 has bore 420, such that end of the spring 125 is housed within bore 420. FIG. 5 also shows flanges 235, 237, the flanges 235, 237 acting as wings to slide on the sliding surfaces 610, 620 of the inner rocker 140.

The locking member also has flanges 225 and 230 that correspond to various locking features on the switch bracket 110. Locking member 120 is also shown having inverted bore sections 410 and 415 coring for injection molding. Flanges 235, 237 also have vertical sections 425, 430 respectively that allow for capture by the outer rocker 140. This is shown more clearly in FIG. 6.

Figure 6:
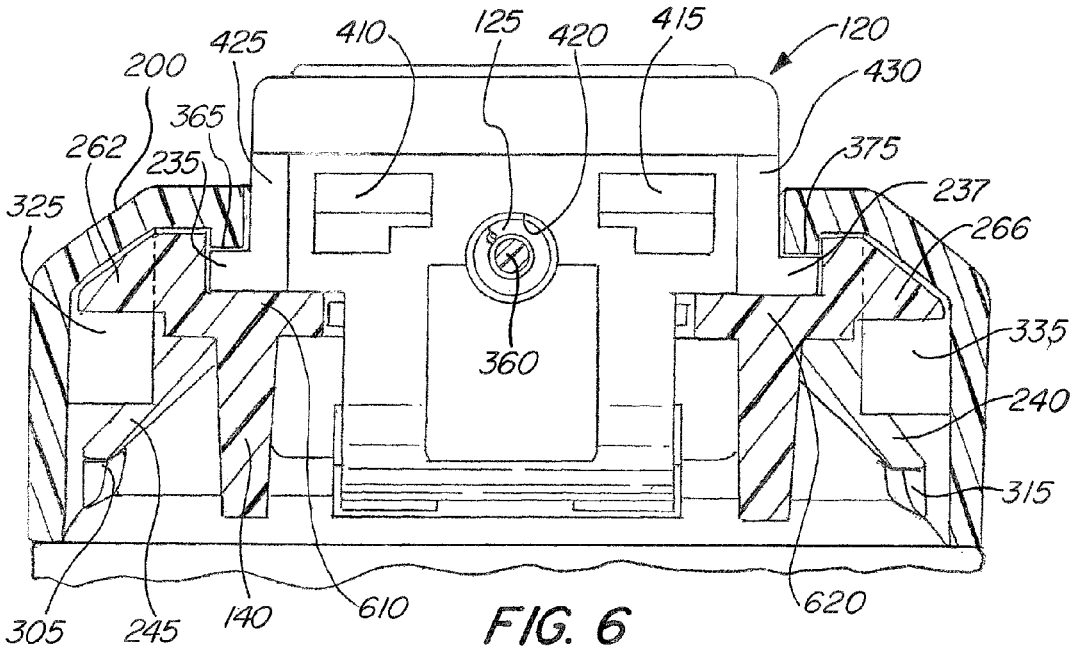
FIG. 6 is a cross-section view of the locking member held within the rocker assembly of FIG. 1.

FIG. 6 is a cross section view of locking member 120 held within the rocker assembly 100 of FIG. 1. FIG. 6 shows the locking member 120 being held within the outer rocker 200 and inner rocker 140. The flanges 235, 237 having vertical sections 425, 430 respectively are shown being retained by a sliding surface 610 and 620 of the inner rocker 140. The locking member 120 is able to slide longitudinally along sliding surfaces 610, 620 to move the locking member 120 from an unlocked (disengaged) to a locked (engaged) position, and in turn allowing the rocker assembly to pivot and change the switch setting.

Also shown in FIG. 6 is the bore 420 in the locking member 120 housing one end of the spring 125. Latch beams 245 and 240 are also shown being retained by retaining members 305 and 315 respectively. Also shown are external flanges 262 and 266 interacting with the outer rocker 200 to secure the inner rocker 140 within the outer rocker 200. Further shown are guides 325 and 335 used to retain the inner rocker 140.

The locking member 120 and rocker assembly 100 provides permanent lock retention and prevents inadvertent lock removal during switch operation, which is a problem with some prior art designs.

Figure 9A:
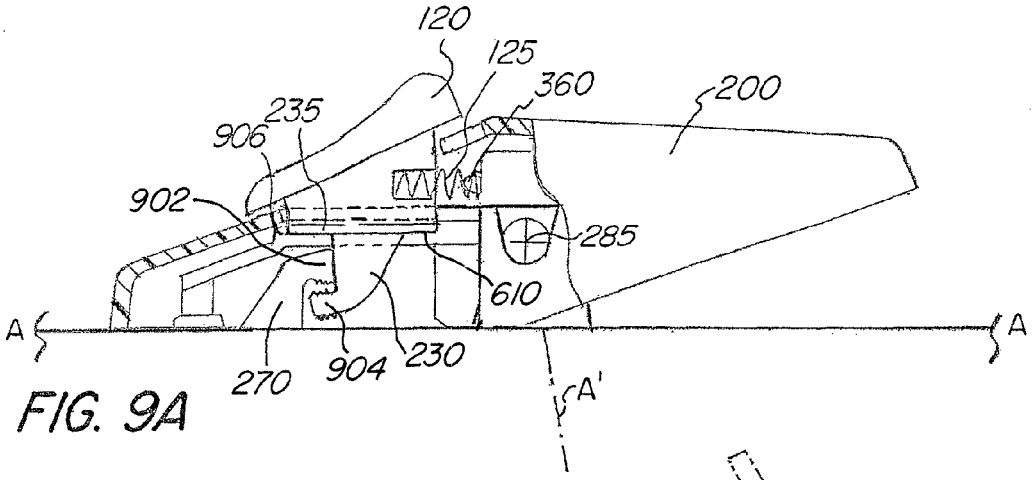
FIGS. 9A-9F are cross-section views of the locking member of FIG. 1 and its engagement with locking features on the switch bracket.
Figure 9B:
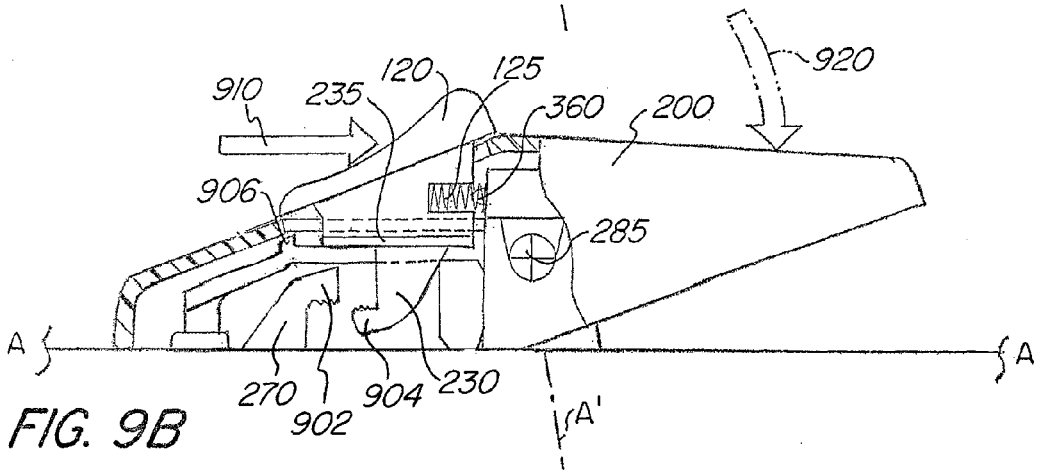
Figure 9C:
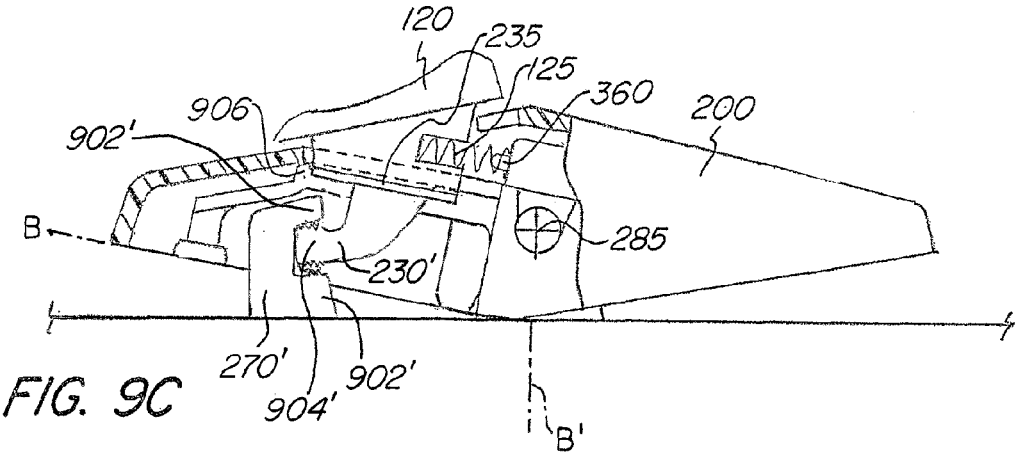
Figure 9D:
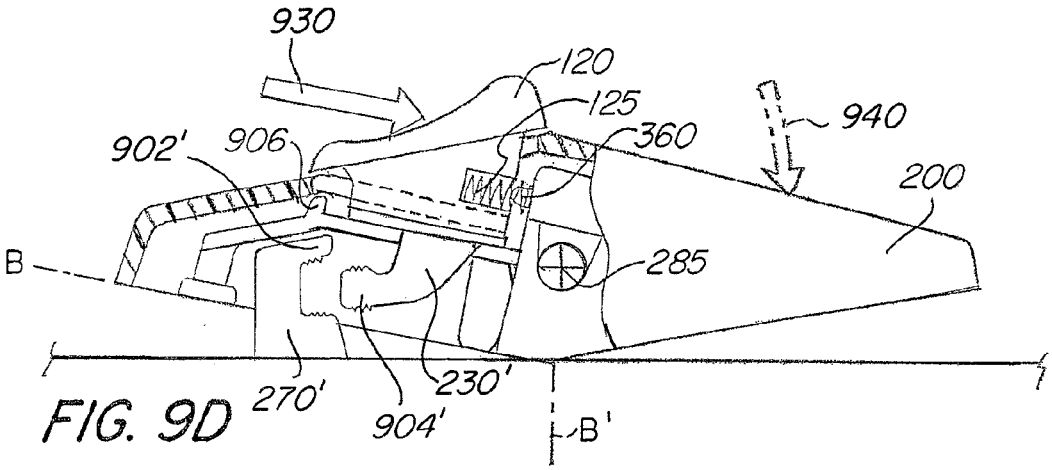
Figure 9E:
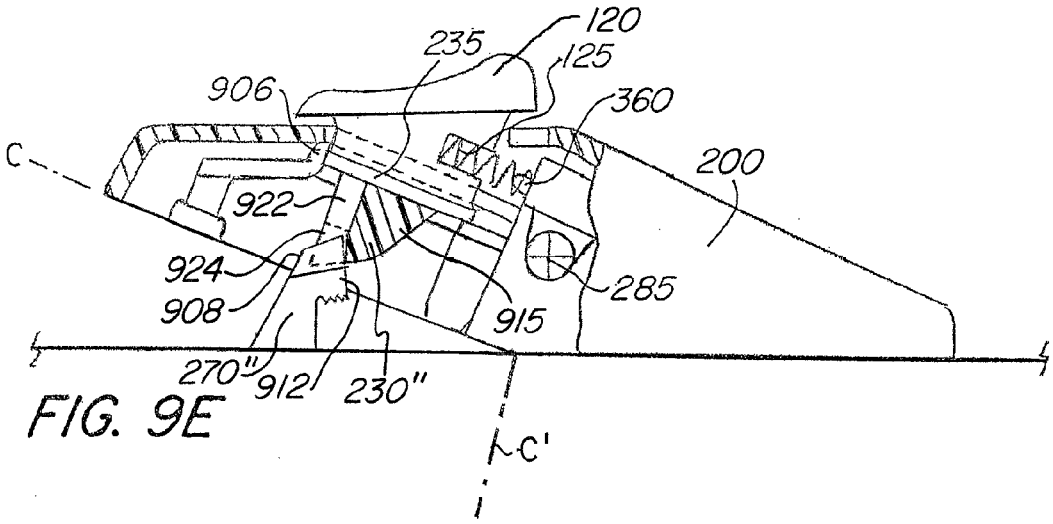
Figure 9F:
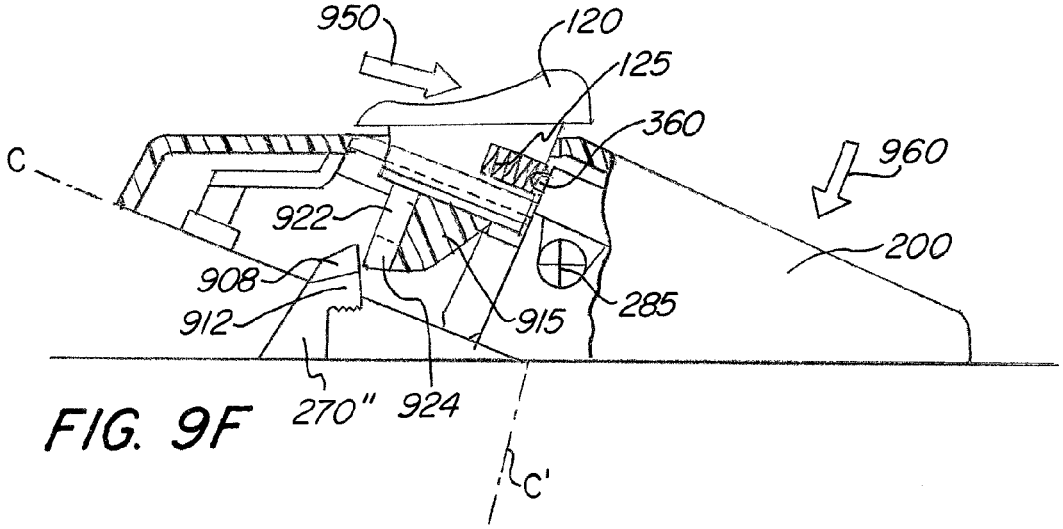

The actuation locking member 120 is shown in FIGS. 9A-9F, whereby the locking features 225 and 230 mate with the locking features 270, 270' and 270" on the switch bracket 110. Various embodiments are shown in FIGS. 9A-9F demonstrating this engagement. Specifically, the lock down, lock mid and lock up positions are shown in both locked (engaged) and unlocked (disengaged) positions. FIGS. 9A-9B show the lock down position, FIGS. 9C-9D show the lock mid position and FIGS. 9E-9F show the lock up position.

FIG. 9A shows locking member 120 in a locked (engaged) lock down position whereby locking features 225 and 230 mate with flange 902 on the locking feature 270. Locking feature 270 has a single finger-like flange 902 which extends laterally away from the locking feature 270 to receive the locking feature 230.

In FIG. 9A, the locking feature 230 is shown engaged with and below locking flange 902, such that the top surface of flange 904 interacts with the bottom surface of flange 902. In certain embodiments, the flange 904 is threaded or ribbed for better engagement with finger-like flange 902 on the locking feature 904.

In FIG. 9A, the rocker assembly 100 is shown being parallel to the switch bracket 110. Furthermore, the spring 125 is shown being held in place via the post 360 and stop member 906 as flange 235 is being held in place on the sliding surface 610 of the inner rocker in the locked (engaged) position. Furthermore, the rocker assembly 100 is secured to the switch bracket 110 via the bracket pivot point 285.

FIG. 9A also shows the stem 260 being in the A' position, whereby the stem is angled to the right. This is the locked (engaged) lock down position whereby the rocker switch 1000 is turned off and the locking member 120 is in the locked (engaged) lock down position.

In FIG. 9B, the locking member 120 is actuated by a movement shown by arrows 910 and 920 and is disengaged from the locking feature 270. The actuation of the locking member 120 occurs through a user using force to push the locking member 120 horizontally to the right (as shown by arrow 910) and then the user pushes the outer rocker 200 down (as shown by arrow 920).

By moving the locking member 120 horizontally, this opens the lock and causes the locking member 120 to slide longitudinally (horizontally) along the sliding surface 610 of the inner rocker 140 to disengage the locking feature 230 from the locking feature 270.

Once the locking feature 230 is disengaged from the locking feature 230, the rocker assembly 100 is free to be able rock on the switch bracket 110, so that the position of the stem moves from the A' position as the rocker switch 1000 is actuated. This allows the rocker switch 100 rock or pivot with respect to the switch bracket 110.

FIG. 9C shows another embodiment of the invention whereby the rocker assembly 100 is in the lock mid position. In FIG. 9C, locking feature 270' is shown having two finger-like flanges 902'. FIG. 9C also shows the stem being in the B' position whereby the rocker switch 100 is not parallel with the switch bracket 110, as it is angled up and away from the switch bracket 110. The stem is in the B' position, which causes actuation or partial actuation of the switch. This is the lock mid position.

In FIG. 9C, the rocker assembly 100 is shown being a locked (engaged) position where the locking member 120 is spring-biased and locked and engaged in the center groove of the locking feature 270' in the central position. The spring 125 is shown being held in place via the post 360 and stop member 906 as flange 235 is being held in place on the sliding surface 610 of the inner rocker. Furthermore, the rocker assembly 100 is secured to the switch bracket 110 via the bracket pivot point 285.

FIG. 9D shows the locking feature 230 disengaged from the center groove between flanges 902' and 902' of the locking feature 270'. The disengagement of the locking feature 230 from the locking feature 270' involves pushing the locking member 120 horizontally to the right (as shown by arrow 930) and pushing the outer rocker 200 down (as shown by arrow 940. This causes the disengagement of the locking features and allows the rocker switch 100 rock or pivot with respect to the switch bracket 110.

FIG. 9E shows another embodiment of the invention whereby the rocker assembly 100 is in the lock up position. In FIG. 9E, locking feature 270" is shown having a single finger-like flange 902". FIG. 9E also shows the stem being in the C' position whereby the rocker switch 100 is not parallel with the switch bracket 110, as it is angled up and away from the switch bracket 110. The stem is in the C' position, which causes actuation or partial actuation of the switch. This is the lock up position.

In the lock up position, the rocker switch 100 is at a greater angle away from the switch bracket than in the lock mid position.

In FIG. 9E, the rocker assembly 100 is shown being a locked (engaged) position where the locking member 120 is spring-biased and locked and engaged under the locking feature 270". The spring 125 is shown being held in place via the post 360 and stop member 906 as flange 235 is being held in place on the sliding surface 610 of the inner rocker. Furthermore, the rocker assembly 100 is secured to the switch bracket 110 via the bracket pivot point 285.

In FIG. 9E, locking feature 230 has a body 915 having an extension member 922/924. Extension member 922/924 is shown having an upper portion 922 and a lower portion 924. The lower portion 924 is engaged with the flange 902" on the locking feature 270", such that in the engaged lock up position the lower portion 924 of the extension member sits on flange 902" and the body 915 is flush with a surface (top portion 908) of the flange 902"

Also shown is that locking feature 230 has flange 902" having a top portion 908 and bottom portion 912. The bottom portion 912 is engaged with the lower portion 924 of the extension member when in the locked position. The top portion 908 is engaged with the body 915 such that the body 915 is flush with the top portion 908.

FIG. 9F shows the locking feature 230 disengaged from the flange 902" of the locking feature 270". The disengagement of the locking feature 230 from the locking feature 270" involves pushing the locking member 120 horizontally to the right (as shown by arrow 95) and pushing the outer rocker 200 down (as shown by arrow 960). This causes the disengagement of the locking features and allows the rocker switch 100 rock or pivot with respect to the switch bracket 110.

Figure 9G:
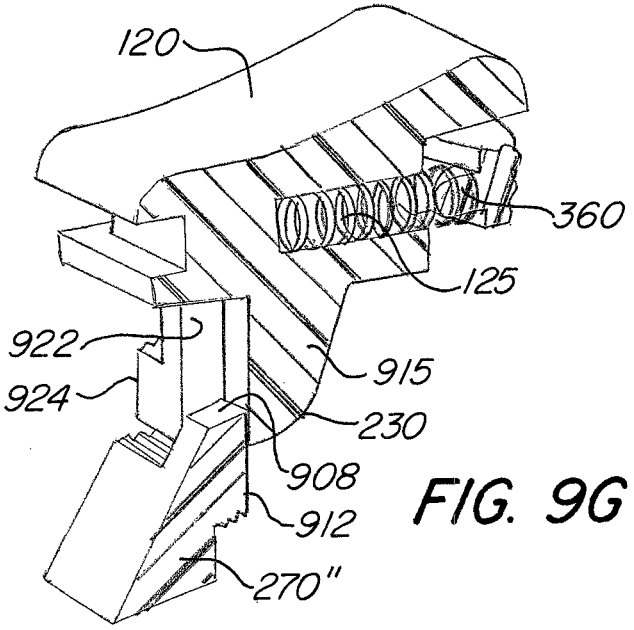
FIGS. 9G-9H are cross-sectional and perspective views of the interaction of the locking member of FIG. 5 with the locking feature of FIGS. 9E-9F.

FIG. 9G shows a cross sectional view of the engagement of the interaction of locking feature 230 with locking feature 270" shown in FIGS. 9E-9F. In FIG. 9G, locking member 120 is shown having a locking feature 230. Locking feature 230 has body 915 and extension member extension member 922/924. Extension member 922/924 is shown having an upper portion 922 and a lower portion 924. As shown, lower portion 924 has a larger width than upper portion 924. The lower portion 924 is shown being able to engaged with the upper surface 912 of the bottom portion 912 of the locking feature 230.

Figure 9H:
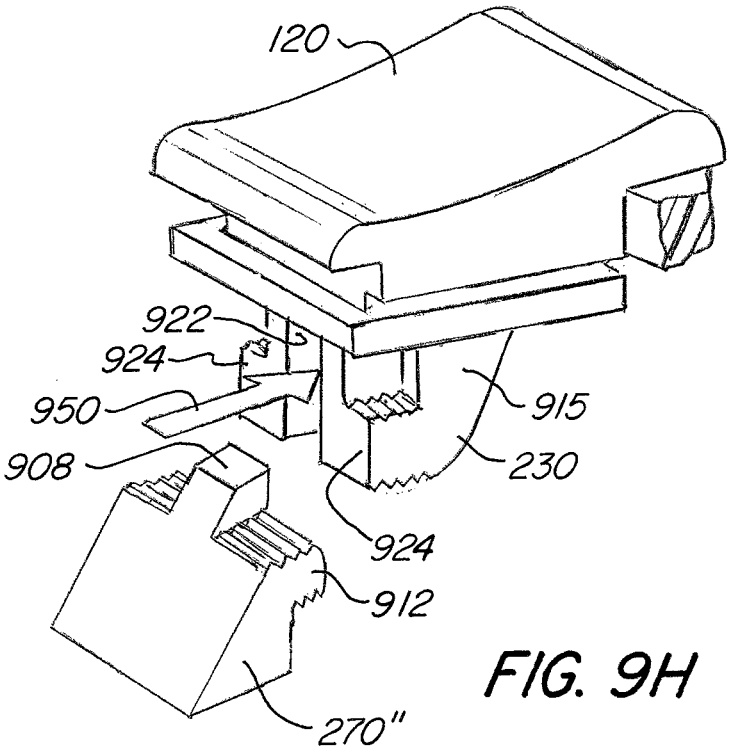

FIG. 9H shows a perspective view of the engagement of the interaction of locking feature 230 with locking feature 270". Here, the locking feature 270" is shown whereby top portion 908 extends above the bottom portion 912 and whereby the locking feature 230 and locking feature 270" mate with one another through movement of the features along the direction of arrow 950. Top portion 908 fits within a sleeve between flanges 924 of locking feature 230 when the locking features are engaged with one another.

In certain embodiments, the primary lock function of locking member 120 is to prevent inadvertent actuation of the switch (unwanted change of setting). The lock is spring loaded to stay in the desired lock position. The operator pushes the lock button to disengage the locking mechanism from the locking features (locking bracket) to change switch settings. The new design incorporates flanges on either side of the lock that are captured in a pocket formed between the inner rocker 140 and outer rocker 200 to prevent inadvertent lock extraction.

In certain embodiments, the locking features 270' may be replaced by a locking feature with additional flanges and/or prongs, such as locking features 270 and 270" shown in various embodiments of the invention.

Figure 7:
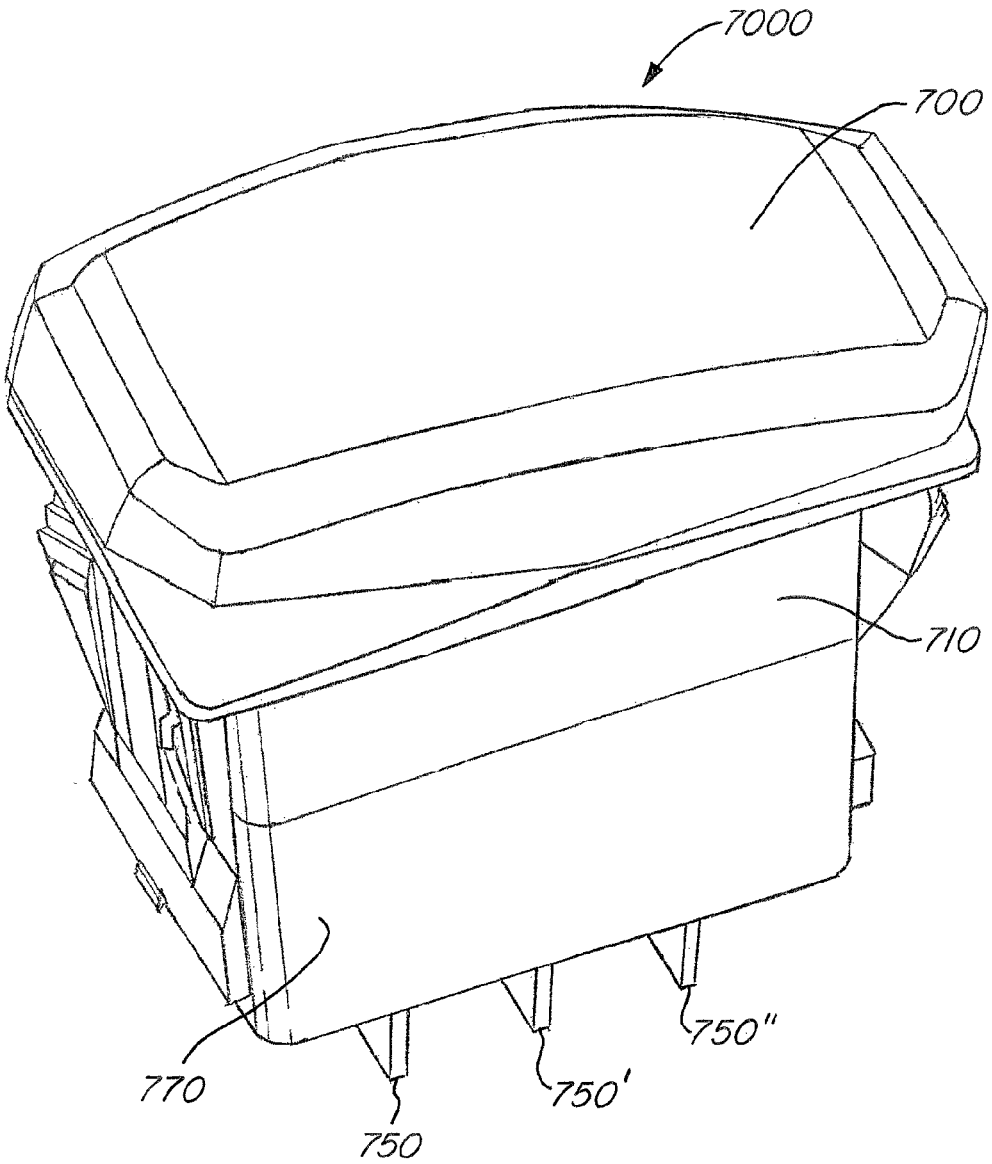
FIG. 7 is a perspective view of a rocker switch of another embodiment of the present invention.

FIG. 7 is a perspective view of a rocker switch 7000 of another embodiment of the present invention involving a non-locking rocker assembly 700. Here, the rocker switch 7000 is shown having a rocker assembly 700 mounted on switch bracket 710. Switch bracket 710 is in turn mounted on a switch base 770. The switch base 770 is a standard switch base and bracket 710 is a standard switch bracket. However, the rocker assembly 100 is a new 2-piece snap fit assembly where the inner rocker snaps into the outer rocker.

Figure 8:
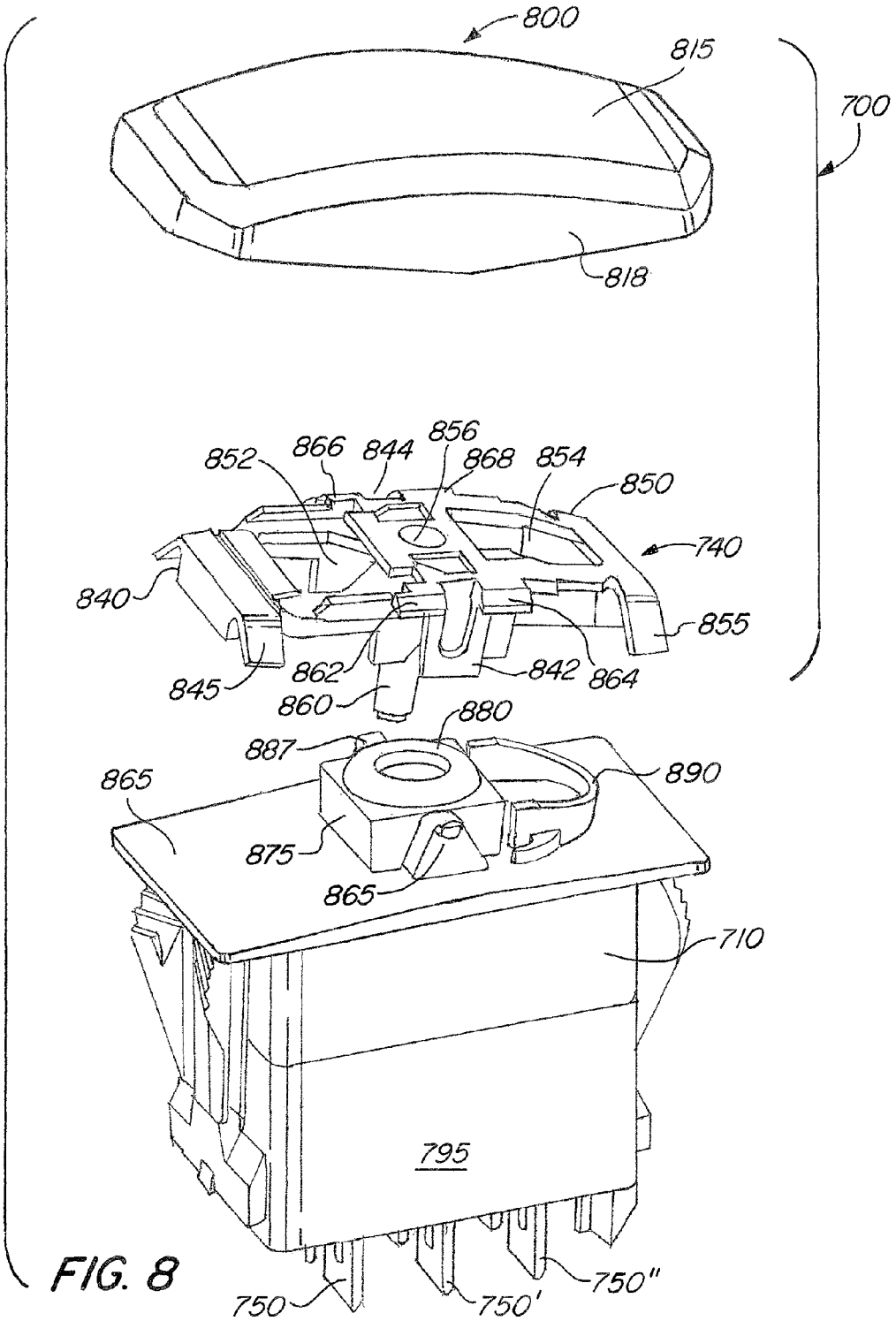
FIG. 8 is an exploded view of the rocker switch of FIG. 7.

FIG. 8 is an exploded view of the rocker switch 7000 of FIG. 7. Referring to FIG. 8, rocker switch 7000 includes outer rocker 800 having a top surface 815 and a body 818. The body 818 of the outer rocker 800 is curved and has an arc shape. In certain embodiments, the outer rocker 800 is made of a hard plastic material or an insulating material. In certain embodiments, the outer rocker is a shell or a cap.

Inner rocker 740 is also shown in FIG. 8 and combined with outer rocker 800 forms rocker assembly 700. Inner rocker 740 has four latch beams 840, 845, 850 and 855. In certain embodiments, latch beams 840, 845, 850 and 855 are each in a corner of the inner rocker 740. In other embodiments, the latch beams 840, 845, 850 and 855 are angled at a plane away from the body of the inner rocker 740.

Inner rocker 740 also has various features 842 and 844 to snap onto the bracket pivot point. Inner rocker also has windows 852 and 854, as well as bore 856. Window 852 and 854 allow the inner rocker to have a cavity, so that the inner rocker 740 is able to pivot along the switch bracket 710. Inner rocker 740 also has a stem 860. The stem 860 engages with the switch actuator to turn the switch on and off. The inner rocker 740 also has pockets to guide and retain the lock flanges. Windows 852 and 854 can also be used to allow LEDs to illuminate the rocker 800.

FIG. 8 also has external flanges 862, 864, 866 and 868 as well as horizontal flanges 832, 834, 836 and 838. The external flanges and horizontal flanges allow the inner rocker 740 to be secured within the body of the outer rocker 800. In certain embodiments, inner rocker 740 transmits light for image illumination and can accept paint.

FIG. 8 also has a switch bracket 710 having an upper surface 865. Switch bracket 710 also has a bore 280 that receives the stem 860. The bore is supported by a support mount 875 and vertical protrusions 885 and 887 as well as a tapered section 890. The inner bracket 740 is mounted on the support mount 875 and is able to pivot with respect to the support mount 875 and the tapered section 890. In certain embodiments, the tapered section 890 is hollow, so that a cavity is formed that allows the inner rocker 740 to pivot along the bracket 710.

Also shown in FIG. 8 is switch base 870 having a body 895 and electrical connections 750, 750' and 750". As shown there are three electrical connections, though additional or fewer electrical connections may be used in the invention.

In certain embodiments of the invention the rocker assembly is a 2-piece snap together rocker/sub-rocker design incorporating self-centering truss like snap latches. The new design is an improvement over the prior art 2-shot over molding process that requires much more expensive tooling.

While the invention has been specifically described in connection with certain specific embodiments thereof, it is to be understood that this is by way of illustration and not of limitation, and that various changes and modifications in form and details may be made thereto, and the scope of the appended claims should be construed as broadly as the prior art will permit.

The description of the invention is merely exemplary in nature, and, thus, variations that do not depart from the gist of the invention are intended to be within the scope of the invention. Such variations are not to be regarded as a departure from the spirit and scope of the invention.

What is claimed is:

1. A rocker switch comprising:

a switch base;

a bracket mounted on the switch base; and a rocker assembly mounted on the bracket, the rocker assembly able to pivot on the bracket, the rocker assembly including:

an outer rocker having an interior body, the interior body of the outer rocker having at least one retention member extending inwardly from an interior surface of the outer rocker;

an inner rocker snap-fit within the outer rocker, the inner rocker having at least one latch beam that is snapped below the at least one retention member to cause the inner rocker to be secured within the inner body of the outer rocker;

a locking member having a body slideable within a pocket between the inner rocker and the outer rocker;

a spring providing a force against the locking member; and a post located on the inner rocker, the post supporting a first end of the spring to prevent the locking member from sliding along a surface of the inner rocker;

wherein the locking member has a center hole for housing a second end of the spring, the spring being contained in a compressed state between the center hole of the locking member and the post located on the inner rocker.

2. The rocker switch of claim 1, wherein the outer rocker has four retention members and the inner rocker has four latch beams, wherein each of the four retention members are correspondingly engaged with one of the four latch beams to secure the inner rocker within the inner body of the outer rocker.

3. The rocker switch of claim 2, wherein the inner rocker is secured to the outer rocker by snap-fitting the inner rocker within the inner body of the outer rocker, such that the snap-fitting occurs during assembly of the rocker switch.

4. The rocker switch of claim 2, wherein the inner rocker has a body having a substantially rectangular shape and at least one opening within the body.

5. The rocker switch of claim 4, wherein each of the four latch beams are located at each corner of the rectangular shape of the inner rocker and wherein the four latch beams are each angled in a plane away from the body of the inner rocker.

6. The rocker switch of claim 1, wherein the inner rocker has a stem, the stem engaged with the switch base.

7. The rocker switch of claim 1, wherein the at least one latch beam is snapped in underneath the retention member, such that the at least one beam is held in place by the retention member securing the inner rocker within the inner body of the outer rocker.

8. The rocker switch of claim 1, wherein the outer rocker has at least one guide, the at least one guide able to retain the inner rocker within the inner body of the outer rocker.

9. The rocker switch of claim 8, wherein the inner rocker has at least one horizontal flange, the at least one horizontal flange able to engage with the at least one guide to retain the inner rocker within the outer rocker.

10. The rocker switch of claim 9, wherein the outer rocker has four guides and the inner rocker has four horizontal flanges, the four guides engaged with the four horizontal flanges to retain the inner rocker within the outer rocker.

11. The rocker switch of claim 10, wherein the inner rocker has four external flanges, the four external flanges engaged with the four guides to secure the inner rocker within the outer rocker.

12. The rocker switch of claim 1, wherein the outer rocker has a window.

13. The rocker switch of claim 1, further comprising locking features on the locking member, the locking features able to engage with corresponding locking features on the switch bracket.

14. The rocker switch of claim 1, wherein the locking member has flanges on either side of the locking member, the flanges being captured in the pocket formed between the outer rocker and the inner rocker, the flanges being retained on the sliding surface for sliding the locking member along the surface of the inner rocker.

15. A method for manufacturing a rocker switch, the method comprising the steps of:

providing a switch base;

mounting a bracket on the switch base;

providing a rocker assembly including an outer rocker having at least one retention member extending inwardly from an interior surface of the outer rocker and an inner rocker having at least one latch beam;

snap-fitting the inner rocker within the outer rocker, so that the at least one latch beam is snapped below the at least one retention member to secure the inner rocker within the outer rocker;

providing a locking member having a body slideable within a pocket between the inner rocker and the outer rocker;

providing a spring providing a force against the locking member;

providing a post located on the inner rocker, the post supporting a first end of the spring to prevent the locking member from sliding along a surface of the inner rocker;

wherein the locking member has a center hole for housing a second end of the spring, the spring being contained in a compressed state between the center hole of the locking member and the post located on the inner rocker; and mounting the rocker assembly on the bracket.

16. The method of claim 15, further comprising providing a locking member and placing the locking member between the outer rocker and inner rocker prior to snap-fitting the inner rocker within the outer rocker, so that the locking member is held in a pocket between the outer rocker and inner rocker.

17. A rocker switch comprising:

a switch base;

a bracket mounted on the switch base; and a rocker assembly mounted on the bracket, the rocker assembly able to pivot on the bracket, the rocker assembly including:

an outer rocker having four retention members extending inwardly from an interior surface of the outer rocker;

an inner rocker having four latch beams, each one of the four latch beams being snapped below one of the four retention members to cause the inner rocker to be secured within the outer rocker; and a locking member, the locking member located within a pocket between the inner rocker and a window of the outer rocker, the locking member including a sliding surface for sliding the locking member along a surface of the inner rocker and a spring providing a force against the locking member sliding along the surface of the inner rocker, such that the locking member is able to move from a closed position to an open position by sliding the locking member longitudinally along the sliding surface of the inner rocker, a post located on the inner rocker, the post supporting a first end of the spring to prevent the locking member from sliding along a surface of the inner rocker;

wherein the locking member has a center hole for housing a second end of the spring, the spring being contained in a compressed state between the center hole of the locking member and the post located on the inner rocker wherein the inner rocker is secured to the outer rocker in a snap-fit manner.

18. A rocker switch comprising:

a switch base;

a bracket mounted on the switch base; and a rocker assembly mounted on the bracket, the rocker assembly able to pivot on the bracket, the rocker assembly including:

an outer rocker having an interior body, the interior body of the outer rocker having at least one retention member;

an inner rocker having at least one latch beam that engages the at least one retention member to allow the inner rocker to be secured within the inner body of the outer rocker, the inner rocker being snap-fit within the outer rocker;

wherein the outer rocker has a window;

a locking member, the locking member having a body located within a pocket between the inner rocker and the outer rocker;

wherein the locking member is slidable within the pocket between the inner rocker and the outer rocker, wherein the locking member includes a sliding surface for sliding the locking member along a surface of the inner rocker;

a spring, the spring providing a force against the locking member sliding along the surface of the inner rocker;

wherein the inner rocker includes a post, the post supporting a first end of the spring to prevent the locking member from sliding along the surface of the inner rocker and keeping the locking member in a closed position; and wherein the locking member has a center hole for housing a second end of the spring, the spring being contained in a compressed state between the center hole of the locking member and the post located on the inner rocker.

* * * * *